US007440724B2

(12) United States Patent
Morita et al.

(10) Patent No.: US 7,440,724 B2
(45) Date of Patent: Oct. 21, 2008

(54) CLEANING MEMBER, CLEANING UNIT, PROCESS CARTRIDGE, AND ELECTROPHOTOGRAPHIC IMAGE-FORMING APPARATUS

(75) Inventors: Tomokazu Morita, Nagaizumi-machi (JP); Katsunori Yokoyama, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 346 days.

(21) Appl. No.: 11/301,235

(22) Filed: Dec. 12, 2005

(65) Prior Publication Data

US 2006/0127146 A1 Jun. 15, 2006

(30) Foreign Application Priority Data

Dec. 15, 2004 (JP) ..... 2004-362930
Oct. 19, 2005 (JP) ..... 2005-304319

(51) Int. Cl.
*G03G 21/00* (2006.01)

(52) U.S. Cl. ..... 399/351

(58) Field of Classification Search ..... 399/350, 399/351

See application file for complete search history.

(56) References Cited

U.S. PATENT DOCUMENTS 4,284,345 A * 8/1981 Sugiyama et al. ..... 399/351
4,803,752 A * 2/1989 Kasama ..... 399/350 X
5,608,509 A 3/1997 Shirai et al.

FOREIGN PATENT DOCUMENTS

JP 4-295877 A 10/1992

* cited by examiner

*Primary Examiner*—Sandra L Brase
(74) *Attorney, Agent, or Firm*—Canon U.S.A., Inc. I.P. Division

(57) ABSTRACT

A cleaning member configured to remove developer from an electrophotographic photosensitive member includes a longitudinally-shaped planar elastic blade that comes into contact with the electrophotographic photosensitive member to remove the developer from a surface thereof; and a holder supporting the elastic blade. The holder includes an engaging part that engages with the frame to secure the cleaning member to the frame; and a supporting part that holds the elastic blade inside the engaging part to support the elastic blade in the thickness direction thereof.

22 Claims, 15 Drawing Sheets

CLEANING MEMBER, CLEANING UNIT, PROCESS CARTRIDGE, AND ELECTROPHOTOGRAPHIC IMAGE-FORMING APPARATUS

BACKGROUND OF THE INVENTION

1. Field of the Invention

The present invention relates to cleaning units, process cartridges, and electrophotographic image-forming apparatuses.

2. Description of the Related Art

Electrophotographic image-forming apparatuses form images on recording media by an electrophotographic image-forming process. Examples of electrophotographic image-forming apparatuses include electrophotographic copiers, electrophotographic printers (e.g., LED printers and laser beam printers), electrophotographic facsimile machines, and multifunction devices having such functions.

Conventional electrophotographic image-forming apparatuses include process cartridges detachable from the main bodies thereof. These cartridges integrally include an electrophotographic photosensitive member and process units that act thereon. This type of cartridge allows users to perform maintenance of the apparatuses without the assistance of servicepersons, thus greatly improving ease of operation. As a result of their convenience, process cartridges are widely used in electrophotographic image-forming apparatuses.

Process cartridges include a cleaning unit for cleaning a drum-shaped electrophotographic photosensitive member (hereinafter referred to as a photosensitive drum) as a process unit. The cleaning unit is held by a cartridge frame. The cleaning unit has a cleaning member for recovering toner remaining on the circumferential surface of the photosensitive drum. Examples of the cleaning member include webs, fur brushes, rollers, and blades.

Among the aforementioned, blades are most frequently used. An elastic blade is used to scrape residual toner off the surface of the photosensitive drum by bringing an edge of the blade into contact with the surface of the photosensitive drum. On the other hand, a disadvantage of using a cleaning member in the form of a web, a fur brush, or a roller is that it tends to involve a large cleaning unit for structural reasons.

An example of prior art is taught in U.S. Pat. No. 5,608,509, in which a metal sheet supports an elastic blade. This metal sheet is bent to achieve rigidity characteristics so that it can withstand a reaction force applied to the elastic blade from a photosensitive drum. The metal sheet is fixed to a cartridge frame with a screw; therefore, a space for the metal sheet and the screw is required.

In another example of prior art taught in Japanese Patent Laid-Open No. 4-295 877, a cleaning blade is integrally formed with a metal shaft so as to cover the metal shaft . Here, however, the cleaning blade can sag in the middle because the metal shaft is supported only at the longitudinal ends thereof.

It would be desirable to provide a cleaning unit which overcomes the aforementioned disadvantages of the prior art.

SUMMARY OF THE INVENTION

Accordingly, the present invention provides a cleaning unit including a compact cleaning member that can be precisely positioned with respect to an electrophotographic photosensitive member, and also provides a process cartridge and an electrophotographic image-forming apparatus including the cleaning unit.

That is, the present invention provides a cleaning unit configured for use in an electrophotographic image-forming apparatus that forms an image on a recording medium. The cleaning unit includes a frame and a cleaning member for removing developer from an electrophotographic photosensitive member. The cleaning member includes a longitudinally-shaped planar elastic blade that comes into contact with the electrophotographic photosensitive member to remove the developer from a surface thereof and a holder configured to support the elastic blade. The holder includes an engaging part that engages with the frame to secure the cleaning member to the frame and a supporting part configured to hold the elastic blade inside the engaging part to support the elastic blade.

The present invention further provides a process cartridge configured to be detachably attached to a main body of an electrophotographic image-forming apparatus that forms an image on a recording medium. The process cartridge includes a frame, an electrophotographic photosensitive member, and a cleaning member configured to remove developer from the electrophotographic photosensitive member. The cleaning member includes a longitudinally-shaped planar elastic blade positioned to come into contact with the electrophotographic photosensitive member to remove the developer from a surface thereof and a holder configured to support the elastic blade. The holder includes an engaging part that engages with the frame to secure the cleaning member to the frame and a supporting part that holds the elastic blade inside the engaging part to support the elastic blade.

The present invention further provides an electrophotographic image-forming apparatus that forms an image on a recording medium. The electrophotographic image-forming apparatus includes (i) an electrophotographic photosensitive member; (ii) a developing unit for developing an electrophotographic latent image formed on a surface of the electrophotographic photosensitive member; (iii) a conveying unit for conveying the recording medium; and (iv) a cleaning unit. The cleaning unit includes a frame and a cleaning member configured to remove developer from the electrophotographic photosensitive member. The cleaning member includes a longitudinally-shaped planar elastic blade that comes into contact with the electrophotographic photosensitive member to remove the developer from the surface thereof and a holder configured to support the elastic blade. The holder includes an engaging part that engages with the frame to secure the cleaning member to the frame and a supporting part that holds the elastic blade inside the engaging part to support the elastic blade.

The present invention further provides another electrophotographic image-forming apparatus that forms an image on a recording medium. The electrophotographic image-forming apparatus includes (i) a detachable process cartridge including a frame, an electrophotographic photosensitive member, and a cleaning member for removing developer from the electrophotographic photosensitive member. The cleaning member includes a longitudinally-shaped planar elastic blade configured to come into contact with the electrophotographic photosensitive member to remove the developer from a surface thereof and a holder configured to support the elastic blade. The holder includes an engaging part that engages with the frame to secure the cleaning member to the frame and a supporting part that holds the elastic blade inside the engaging part to support the elastic blade in the thickness direction thereof. The electrophotographic image-forming apparatus further includes (ii) an attaching member for detachable attachment of the process cartridge; and (iii) a conveying unit for conveying the recording medium.

The present invention can therefore reduce the size of the cleaning member and precisely position the cleaning member with respect to the electrophotographic photosensitive member.

Further features of the present invention will become apparent from the following description of exemplary embodiments with reference to the attached drawings.

DESCRIPTION OF THE EMBODIMENTS

First Exemplary Embodiment

[Exemplary Electrophotographic Image-Forming Apparatus]

Figure 1:
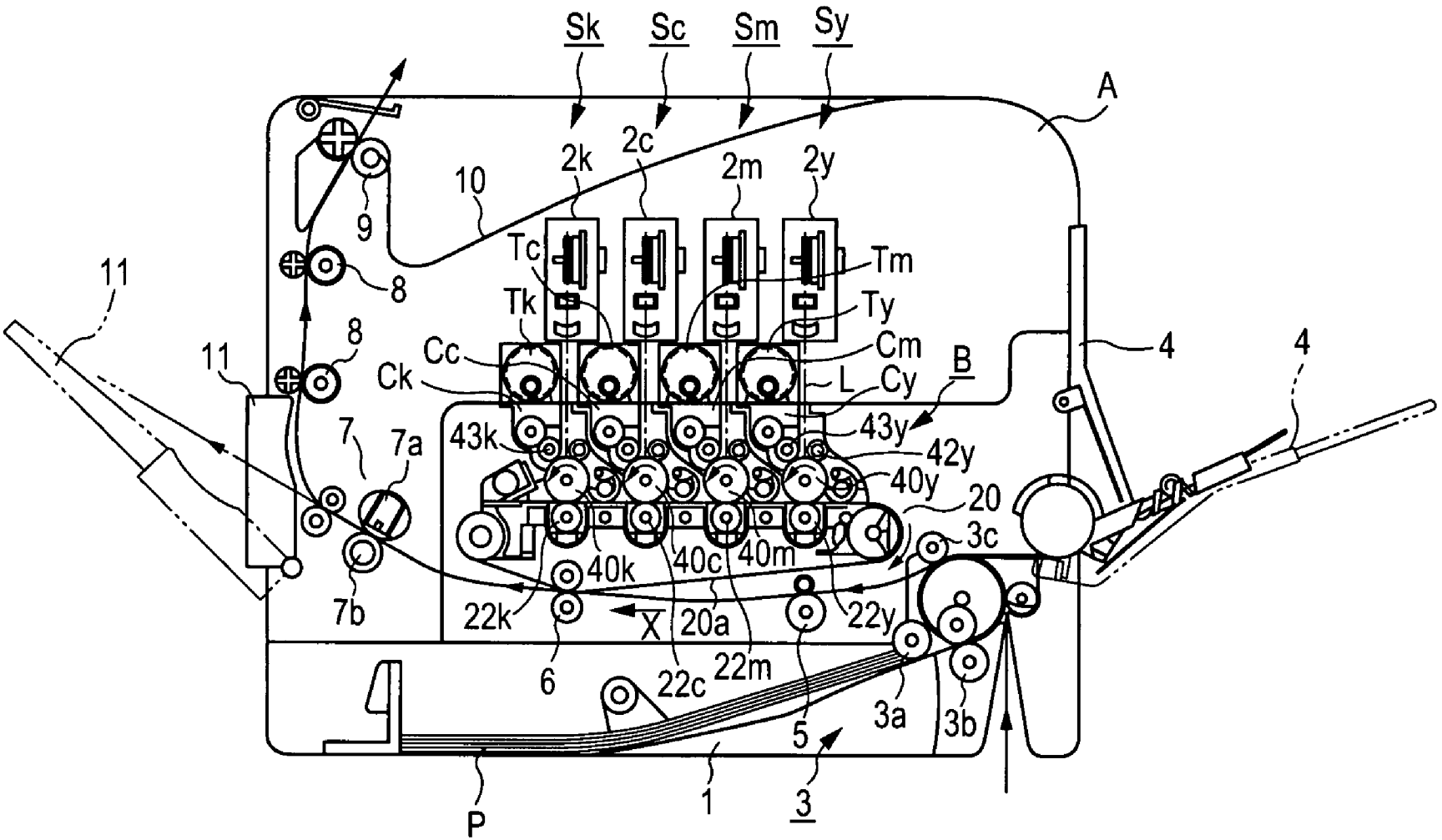
FIG. 1 is a schematic diagram of an exemplary electrophotographic image-forming apparatus according to a first embodiment of the present invention.
Figure 2:
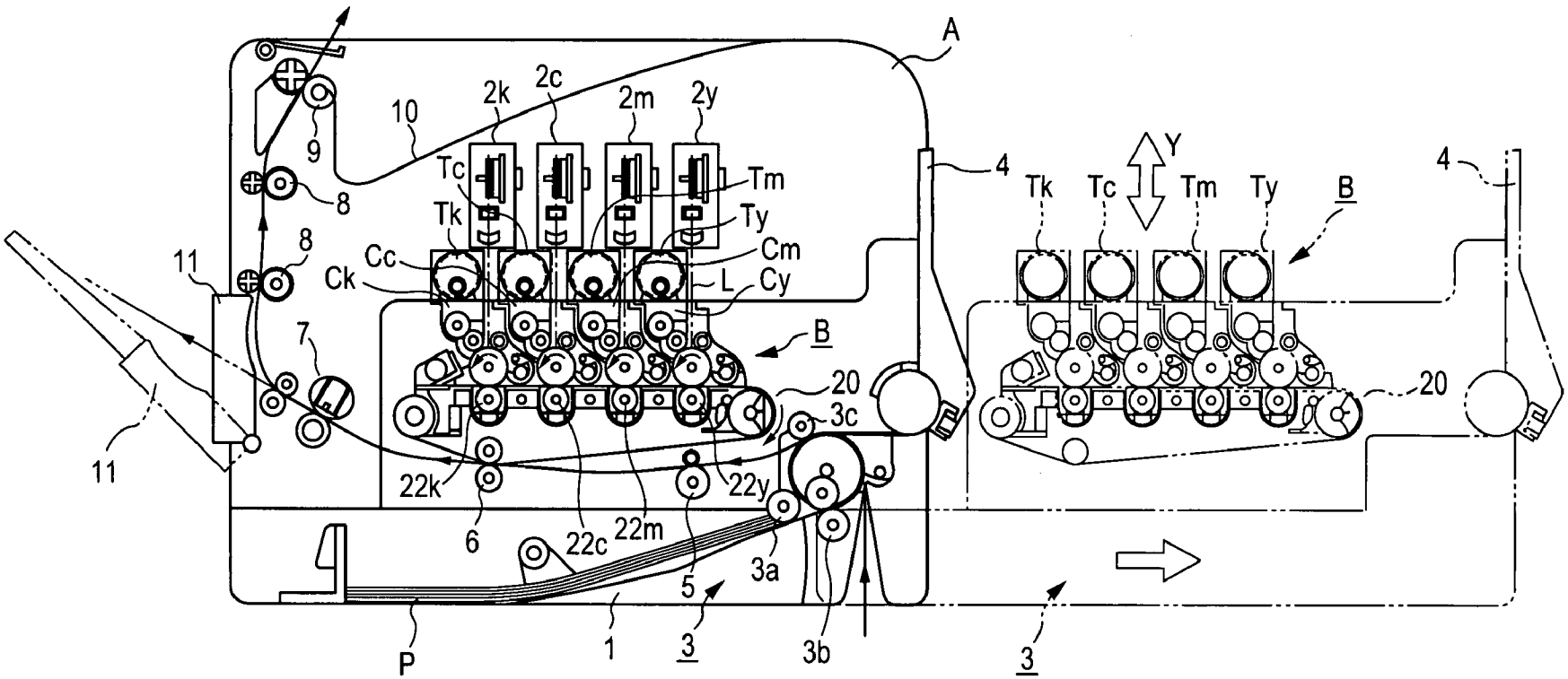
FIG. 2 is a diagram illustrating how a recording medium conveying unit and an image-forming unit are drawn from a main body of the electrophotographic image-forming apparatus.

FIG. 1 is a schematic diagram of an exemplary color electrophotographic image-forming apparatus according to a first embodiment of the present invention. FIG. 2 is a diagram illustrating how a recording medium conveying unit and an image-forming unit are drawn from a main body of the electrophotographic image-forming apparatus.

The color electrophotographic image-forming apparatus according to this embodiment is a laser beam printer that forms images on recording media such as recording paper, OHP sheets, and cloth by an electrophotographic image-forming process. The apparatus includes a main body A, an image-forming unit B, optical units 2 (2*y*, 2*m*, 2*c*, and 2*k*) that can emit a laser beam, a recording medium conveying unit (hereinafter referred to as a "conveying unit") 3, and a fusing unit 7. The optical units 2 are scanner units including a semiconductor laser. These scanner units correspond to the individual colors and are provided in the main body A.

The main body A includes four image-forming stations S (Sy, Sm, Sc, Sk) dedicated to providing yellow, magenta, cyan, and black colors, respectively. The image-forming unit B has process cartridges C (Cy, Cm, Cc, and Ck) and toner cartridges T (Ty, Tm, Tc, and Tk) corresponding to the four colors. These cartridges C and T can be detached from the corresponding image-forming stations S (Sy, Sm, Sc, Sk). The image-forming unit B also has an intermediate transfer unit 20 below the four process cartridges C (Cy, Cm, Cc, and Ck).

In the above structure, for example, a drum-shaped electrophotographic photosensitive member (hereinafter referred to as a "photosensitive drum") 40*y* (see FIG. 1) mounted on the yellow process cartridge Cy is uniformly charged by a charging unit 42*y*. The optical unit 2*y* then emits a laser beam L to form a latent image on the photosensitive drum 40*y*. A developing unit 43*y* develops the latent image with toner, as developer, to form a toner image. The toner image formed on the photosensitive drum 40*y* is transferred to an intermediate transfer belt 20*a*, as an image-bearing member, by the action of a primary transfer roller 22*y*.

Similar image-forming processes are also carried out for the magenta process cartridge Cm, the cyan process cartridge Cc, and the black process cartridge Ck to form toner images of the corresponding colors on the photosensitive drums 40*m*, 40*c*, and 40*k*. Each toner image is sequentially superimposed on the previously formed toner image by each action of transfer rollers 22*m*, 22*c* and 22*k*.

On the other hand, a separate feeding mechanism including a pickup roller 3*a*, a pair of feed/retard rollers 3*b*, and a pair of conveying rollers 3*c* separate the top recording medium P of recording media P stacked in a feeding cassette 1 provided in the bottom of the main body A. The conveying rollers 3*c* then convey the recording medium P to a secondary transfer region through a pair of register rollers 5. A pair of secondary transfer rollers 6 transfer the toner image formed on the intermediate transfer belt 20*a* to the recording medium P. A cleaning blade (not shown) provided on a belt cleaner 21 (see FIGS. 3-5) removes untransferred toner remaining on the intermediate transfer belt 20*a*, which can thus perform the next image-forming process.

The recording medium P having the toner image is carried to the fusing unit 7. The toner image is fused at a nip between a fusing roller 7*a* and a pressure roller 7*b*. The recording medium P having the fused toner image is ejected by ejection rollers 8 and 9 to an output tray 10 provided on the top of the main body A or a side output tray 11 provided on a side of the main body A.

In FIG. 2, the conveying unit 3 integrally includes the secondary transfer rollers 6, the pair of register rollers 5, the separate feeding mechanism (the pickup rollers 3*a*, the pair of feed/retard rollers 3*b*, and the pair of conveying rollers 3*c*), and a multifeed unit 4. This conveying unit 3 is coupled to the main body A with an appropriate mechanism such that the conveying unit 3 can be drawn from the right of the main body A in the drawing (from the multifeed unit 4 side). The image-forming unit B is mounted on the conveying unit 3.

The image-forming unit B can be detached from the conveying unit 3 in the vertical direction (Y direction), which is orthogonal to the direction in which the recording medium P is carried (X direction). The process cartridges C corresponding to the individual colors are detachably attached to the image-forming unit B, and the toner cartridges T are detachably attached to the individual process cartridges C. The detachment mechanism of the process cartridges C and the toner cartridges T will be described later in the specification.

[Exemplary Image-Forming Unit]

Figure 3:
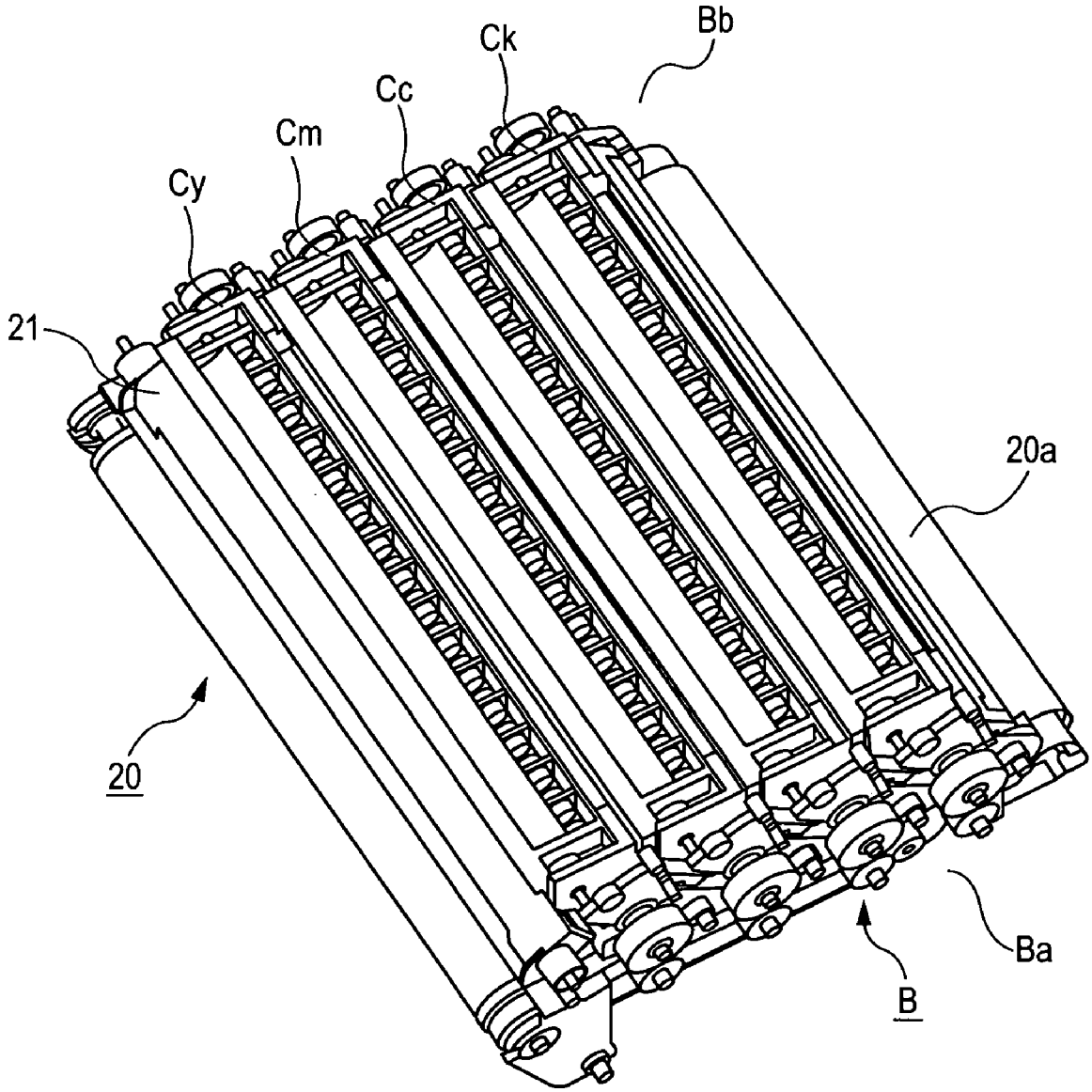
FIG. 3 is a perspective view from above of an exemplary image-forming unit in the state in which toner cartridges are detached from process cartridges.

FIG. 3 is a perspective view from above of the image-forming unit B in the state in which the toner cartridges T are detached from the process cartridges C. In FIG. 3, the image-forming unit B has a generally parallel structure in which the four process cartridges C are arranged in parallel on the intermediate transfer unit 20 to sequentially form yellow, magenta, cyan, and black toner images. Toners of the individual colors are supplied at a constant rate from toner units T mounted on the tops of the process cartridges C. For the electrophotographic image-forming apparatus according to this embodiment, the toner cartridges T have a toner capacity equivalent to a yield of about 3,000 A4 sheets based on 5% print coverage. The image-forming unit B has a lifespan of about 50,000 copies. The image-forming unit B has a drive side Ba and a non-drive side Bb.

Figure 4:
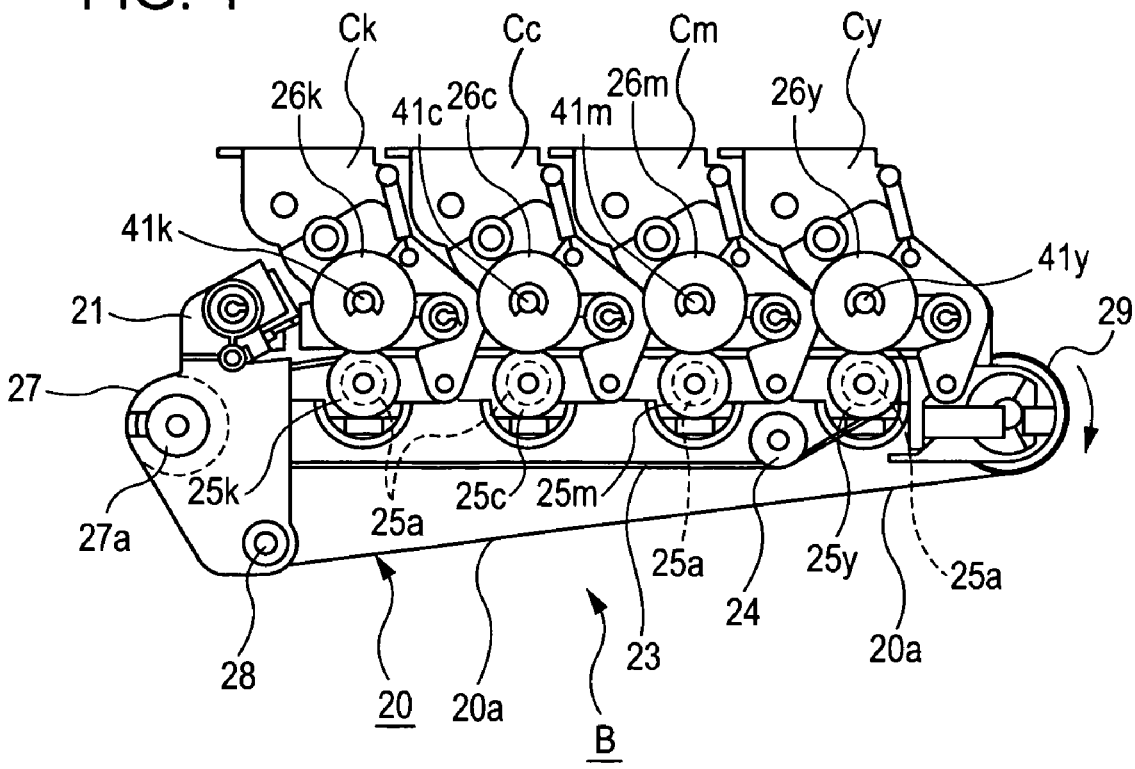
FIG. 4 is a side view illustrating the drive side of the image-forming unit shown in FIG. 3.

FIG. 4 is a side view illustrating the drive side Ba of the image-forming unit B shown in FIG. 3. The standard speed for the image-forming process is the running speed of the intermediate transfer belt 20*a*. In this embodiment, a timing belt 23 transfers a driving force to the individual process cartridges C to synchronize image formation with the standard speed. The intermediate transfer belt 20*a*, which is an endless belt, runs around three stretching rollers 27, 28 and 29 in the intermediate transfer unit 20. The three stretching rollers 27, 28 and 29 are a drive roller, a tension roller, and a driven roller, respectively. The intermediate transfer belt 20*a* runs clockwise in the drawing as the drive roller 27 rotates.

Still referring to FIG. 4, the timing belt 23 is provided inside the intermediate transfer belt 20*a*. This timing belt 23 runs around a drive pulley 27*a* that is coaxial with the drive roller 27, a tension pulley 24, and transfer roller pulleys 25*a* that are coaxial with transfer roller gears 25. The drive pulley 27*a*, which is provided on the drive shaft of the intermediate transfer belt 20*a*, transfers power to the timing belt 23 to drive the transfer drive pulleys 25*a*, which are provided on the shafts of the primary transfer rollers 22 (22*y*, 22*m*, 22*c*, and 22*k*) (see FIG. 1) of the individual stations S. The transfer roller gears 25 (25*y*, 25*m*, 25*c*, and 25*k*) mesh with drum gears 26 (26*y*, 26*m*, 26*c*, and 26*k*) to drive photosensitive drum shafts 41 (41*y*, 41*m*, 41*c*, and 41*k*).

Figure 5:
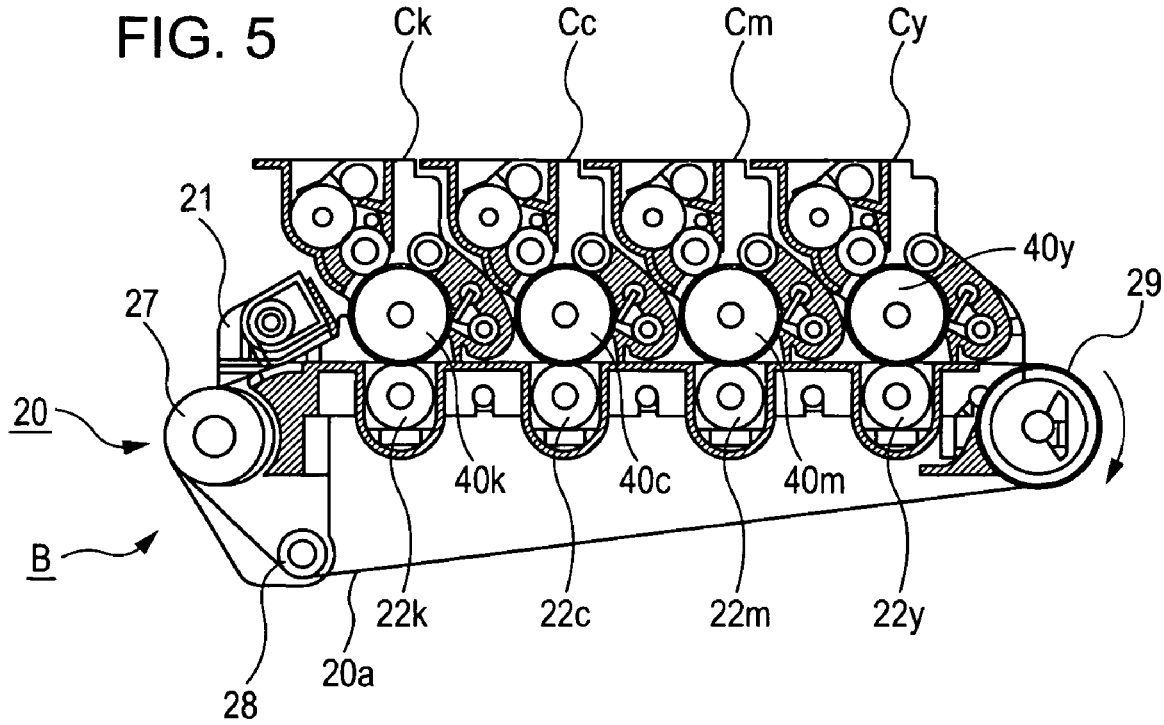
FIG. 5 is a sectional view of the image-forming unit shown in FIG. 4.

FIG. 5 is a sectional view of the image-forming unit B shown in FIG. 4. The primary transfer rollers 22 (22*y*, 22*m*, 22*c*, and 22*k*) are provided opposite the individual photosensitive drums 40 (40*y*, 40*m*, 40*c*, and 40*k*) with the intermediate transfer belt 20*a* disposed therebetween. The individual primary transfer rollers 22 come into contact with the corresponding photosensitive drums 40 to form transfer sites where toner images are transferred from the photosensitive drums 40 to the intermediate transfer belt 20*a*. The intermediate transfer belt 20*a* runs clockwise in the drawing. The yellow, magenta, cyan, and black toner images are transferred to the intermediate transfer belt 20*a* in the above order, and the resultant toner image is transferred to the recording medium P between the secondary transfer rollers 6. The untransferred toner is recovered from the intermediate transfer belt 20*a* by the belt cleaner 21.

[Exemplary Detachment Mechanism of Process Cartridges C and Toner Cartridges T]

Figure 6:
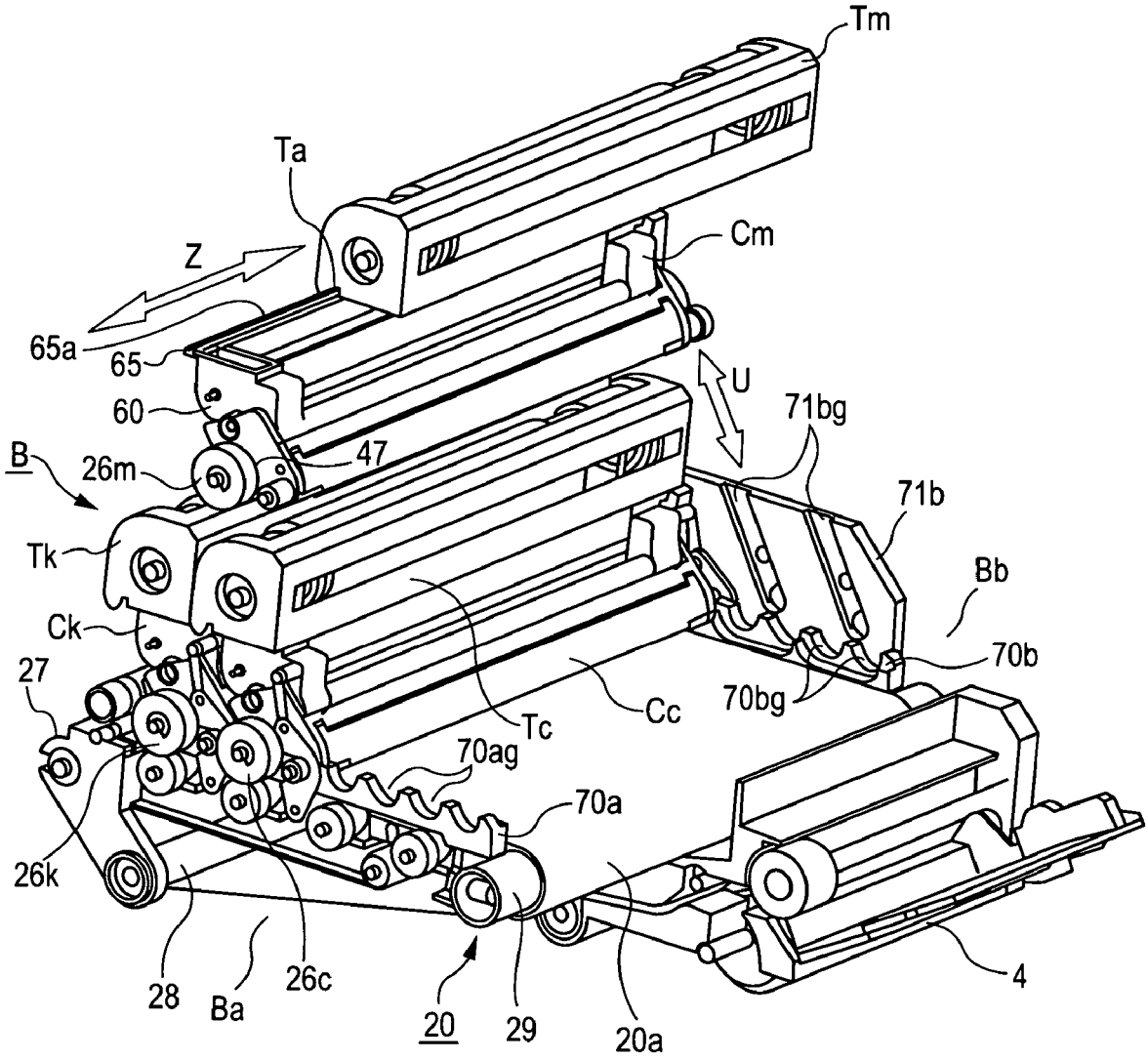
FIG. 6 is a diagram illustrating the detachment mechanism of the process cartridges and the toner cartridges in the image-forming unit.

FIG. 6 is a diagram illustrating an exemplary detachment mechanism of the process cartridges C and the toner cartridges T in the image-forming unit B. The process cartridges C can readily be detached from the image-forming unit B by users, and are removed when the photosensitive drums 40 reach the end of their lifetime. Also, the toner cartridges T can readily be removed from the process cartridges C by users. Toner contained in the toner cartridges T is supplied to the process cartridges C, and the toner cartridges T are removed when they become empty.

The image-forming unit B includes an inner plate 70*a* and an outer plate (not shown) on the drive side Ba and an inner plate 70*b* and an outer plate 71*b* on the non-drive side Bb as attaching members for detachable attachment of the individual process cartridges C. In the drawing, the outer plate (not shown) on the drive side Ba is omitted for illustrative purposes; however, the outer plate on the drive side Ba has the same function as the outer plate 71*b*.

The inner plates 70*a* and 70*b* of the image-forming unit B have U-shaped holding grooves 70*ag* and 70*bg*, respectively, arranged in the direction in which the recording medium P is carried (the X direction in FIG. 1). The outer plate 71*b* of the image-forming unit B has vertically long, U-shaped guide groove 71*bg*, respectively, arranged in the X direction. The guide groove 71*bg* extends in the U direction, which is inclined at a predetermined angle to the X direction.

The individual process cartridges C are fixed to the image-forming unit B by fitting bearings 47 (47*y*, 47*m*, 47*c*, and 47*k*) supporting the photosensitive drum shafts 41 (41*y*, 41*m*, 41*c*, and 41*k*) (see FIG. 8) into the holding grooves 70*ag* of the inner plate 70*a* on the drive side Ba and by fitting bearings (not shown) supporting the photosensitive drum shafts 41 into the holding grooves 70*bg* of the inner plate 70*b* on the non-drive side Bb. The process cartridges C can readily be detached from the image-forming unit B by sliding the photosensitive drum shafts 41 along the guide grooves 71*bg* of the outer plates 71*b* in the U direction.

The process cartridges C each include a developing unit 60 having a top guide surface 65 for guiding the toner cartridges T. The guide surface 65 has a guide rail 65*a*. A guide groove Ta is provided on the bottom surface of each of the toner cartridges T so as to face the guide rail 65*a*. Both the guide rail 65*a* and the guide groove Ta extend in the lateral direction (Z direction), which is orthogonal to the X direction, so that the toner cartridges T can be detached from the corresponding process cartridges C in the Z direction.

The toner cartridges T each have a toner supply outlet (not shown). The toner cartridges T are attached to the process cartridges C with the toner supply outlets communicating with toner supply inlets (not shown) provided on the process cartridges C. In the drawing, the toner cartridge Tm is slid from a predetermined attachment position to the non-drive side Bb for the description of the guide rail 65*a* and the guide groove Ta.

The individual toner cartridges T have the same structure. Each of the toner cartridges T contains toner or a mixture of toner and a magnetic carrier and integrally includes a stirring member (not shown) and a screw (not shown). The mixture is supplied to the developing unit 60 of the process cartridge C while being stirred by the rotation of the stirring member and the screw.

[Exemplary Process Cartridge]

An exemplary process cartridge is an integral cartridge including an electrophotographic photosensitive member and at least one process unit that acts on the photosensitive member. This cartridge can be detachably attached to a main body of an apparatus. Examples of the process unit include a charging unit for uniformly charging the photosensitive member, a developing unit for developing a latent image formed on the photosensitive member with developer, and a cleaning unit for cleaning the photosensitive member. The process cartridges C in this embodiment include a charging unit, a developing unit, and a cleaning unit as process units.

Figure 7:
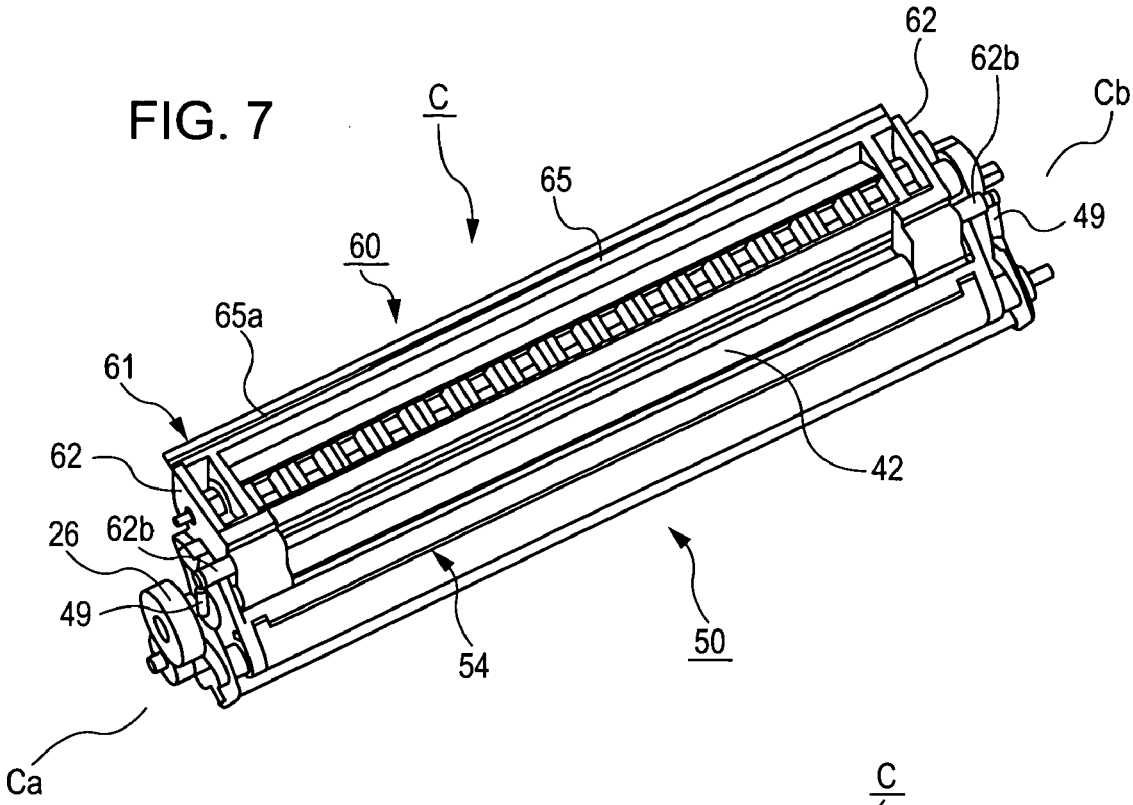
FIG. 7 is a perspective view from above of each of the process cartridges.

FIG. 7 is a perspective view from above of each of the process cartridges C. In FIG. 7, the process cartridge C includes a cleaning unit (hereinafter referred to as a "C unit") 50 and the developing unit (hereinafter referred to as a "D unit") 60, which is coupled to the C unit 50. The process cartridge C has a drive side Ca where the drum gear 26 of the photosensitive drum 40 is disposed and a non-drive side Cb opposite the drive side Ca.

Figure 8:
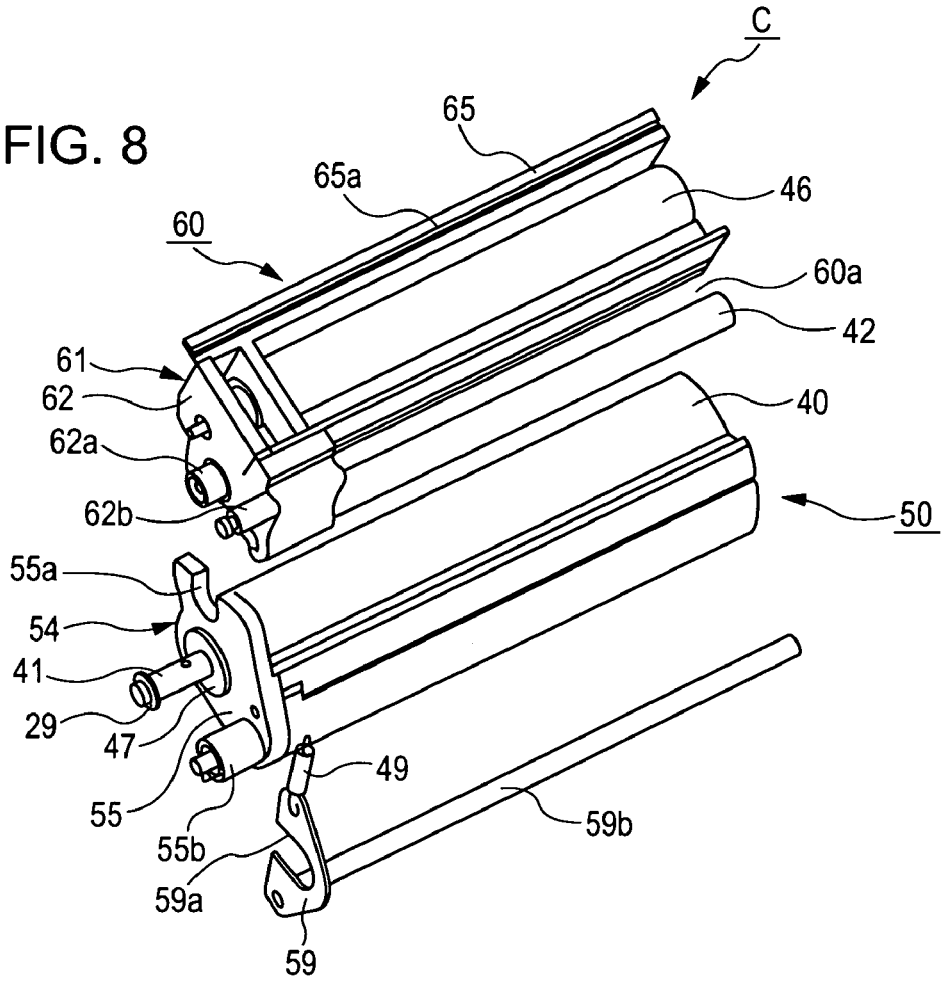
FIG. 8 is an exploded perspective view illustrating how a cleaning unit and a developing unit are coupled on the drive side.

FIG. 8 is an exploded perspective view illustrating how the C unit 50 and the D unit 60 are coupled on the drive side Ca. The C unit 50 and the D unit 60 are also coupled on the non-drive side Cb in a similar manner. The C unit 50 has a cleaning unit frame (hereinafter referred to as a "C unit frame") 54.

The photosensitive drum shaft (hereinafter referred to as a "drum shaft") 41 is rotatably supported with the bearing 47 by a side cover 55 provided on the drive side of the C unit frame 54. A cleaning member 53 is attached to the C unit frame 54 (see FIG. 9). The D unit 60 has a developing unit frame (hereinafter referred to as a "D unit frame") 61. The developing roller 43, as a developing unit, and the charging roller 42, as a charging unit, are rotatably supported with bearings (not shown) by a side cover 62 provided on the drive side of the D unit frame 61. A clearance 60*a* between the charging roller 42 and the D unit frame 61 serves as a window (opening) for exposure to the laser beam L (see FIG. 1).

The manner in which the C unit 50 and the D unit 60 are coupled is now herein described. An end of an SD pressure spring (hereinafter referred to as a "pressure spring") 49, which is a tension coil spring, is secured to a pressure plate 59. The pressure plate 59 is pivotably attached to a frame (not shown) of the intermediate transfer unit 20 (see FIG. 4) with a shaft 59*b*. A U-shaped groove 59*a* formed on the pressure plate 59 engages with a protruding shaft 55*b* provided on the side cover 55 of the C unit 50. The other end of the pressure spring 49 engages with a spring shaft 62*b* provided at an end of the side cover 62 of the D unit 60. The pressure spring 49 brings the developing roller 43 (see FIG. 1) and the charging roller 42 into contact with the photosensitive drum 40.

Figure 9:
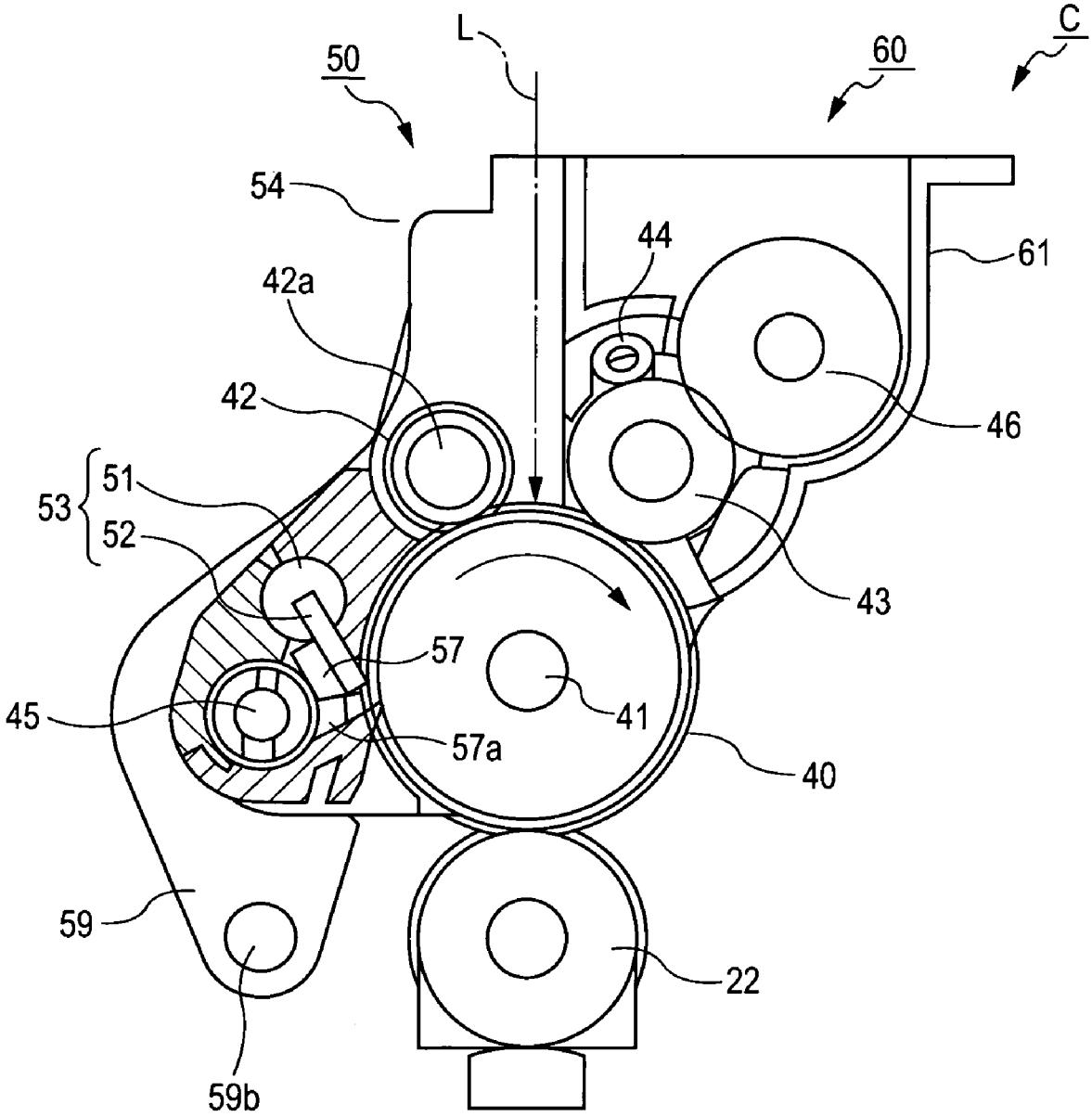
FIG. 9 is a sectional view of the process cartridge.

An exemplary image-forming process of the process cartridge C is now described below with reference to FIG. 9, which is a sectional view of the process cartridge C. The photosensitive drum 40, which is the center of the image-forming process, can be a drawn aluminum cylinder coated with an organic photosensitive conductor (OPC). The organic photosensitive conductor is formed by sequentially coating the cylinder with functional films, namely an undercoat layer (UCL), a carrier-generating layer (CGL), and a carrier-transport layer (CTL).

In the image-forming process, the photosensitive drum 40 is rotated clockwise at a predetermined angular velocity. The charging roller 42, which has a roller portion formed of a conductive rubber, is driven to rotate by the photosensitive drum 40 with the roller portion being in contact with the photosensitive drum 40. When a DC voltage of −700 V, for example, is applied as a dark potential Vd to the photosensitive drum 40 through a metal shaft 42*a* of the charging roller 42, a uniform surface potential distribution with a surface potential of −450 V can be formed on the dielectric coating of the photosensitive drum 40.

The surface with the uniform surface potential distribution is exposed to the laser beam L, which corresponds to image data, in a spot pattern. The optical unit 2 (see FIG. 1) scans substantially the vertically highest position of the photosensitive drum 40 with the laser beam L in a direction parallel to the drum shaft 41. The CGL generates carriers at sites exposed to the laser beam L, and the resultant holes travel through the CTL under the action of the electric field of the uniform surface potential to cancel the surface potential. As a result, a latent image can be formed, which is composed of a surface potential distribution with a light potential Vl of −50 V at the exposed sites and a dark potential Vd of −400 V at the unexposed sites.

A subsequent developing process in this embodiment employs mono-component nonmagnetic contact development. The developing roller 43, which has a roller portion formed of a conductive rubber, is driven by a drive mechanism (not shown) independently of the photosensitive drum 40 with the roller portion being in contact with the photosensitive drum 40. The direction of the tangential velocity of the developing roller 43 is the same as that of the photosensitive drum 40 at the contact site, but the ratio of the tangential velocity of the developing roller 43 to that of the photosensitive drum 40 is about 2:1.

The toner supplied from the toner cartridge T (see FIG. 1) at a constant rate is charged through contact by the interaction among a supply roller 46, a trimmer 44, and the developing roller 43. The toner on the developing roller 43 is adjusted to a desired mass per unit area before the toner is carried to a development site. If a developing bias of −200 V, for example, is applied to the photosensitive drum 40 under the above latent image conditions, a toner image can be formed on the photosensitive drum 40 with a development contrast Vc of 150 V and a back contrast Vbc of 200 V.

The toner image formed on the photosensitive drum 40 is transferred to the intermediate transfer belt 20*a* (see FIG. 5) at a transfer site where the intermediate transfer belt 20*a* is nipped between the photosensitive drum 40 and the primary transfer roller 22. The toner is transferred by the action of the electric field of a transfer voltage applied to the primary transfer roller 22.

An elastic and/or resilient blade 52, formed of urethane rubber, of the cleaning member 53 scrapes the untransferred toner off the surface of the photosensitive drum 40. The untransferred toner is recovered into a waste toner container (not shown) provided on the image-forming unit B by a waste toner screw 45.

[Exemplary Cleaning Unit]

Figure 10:
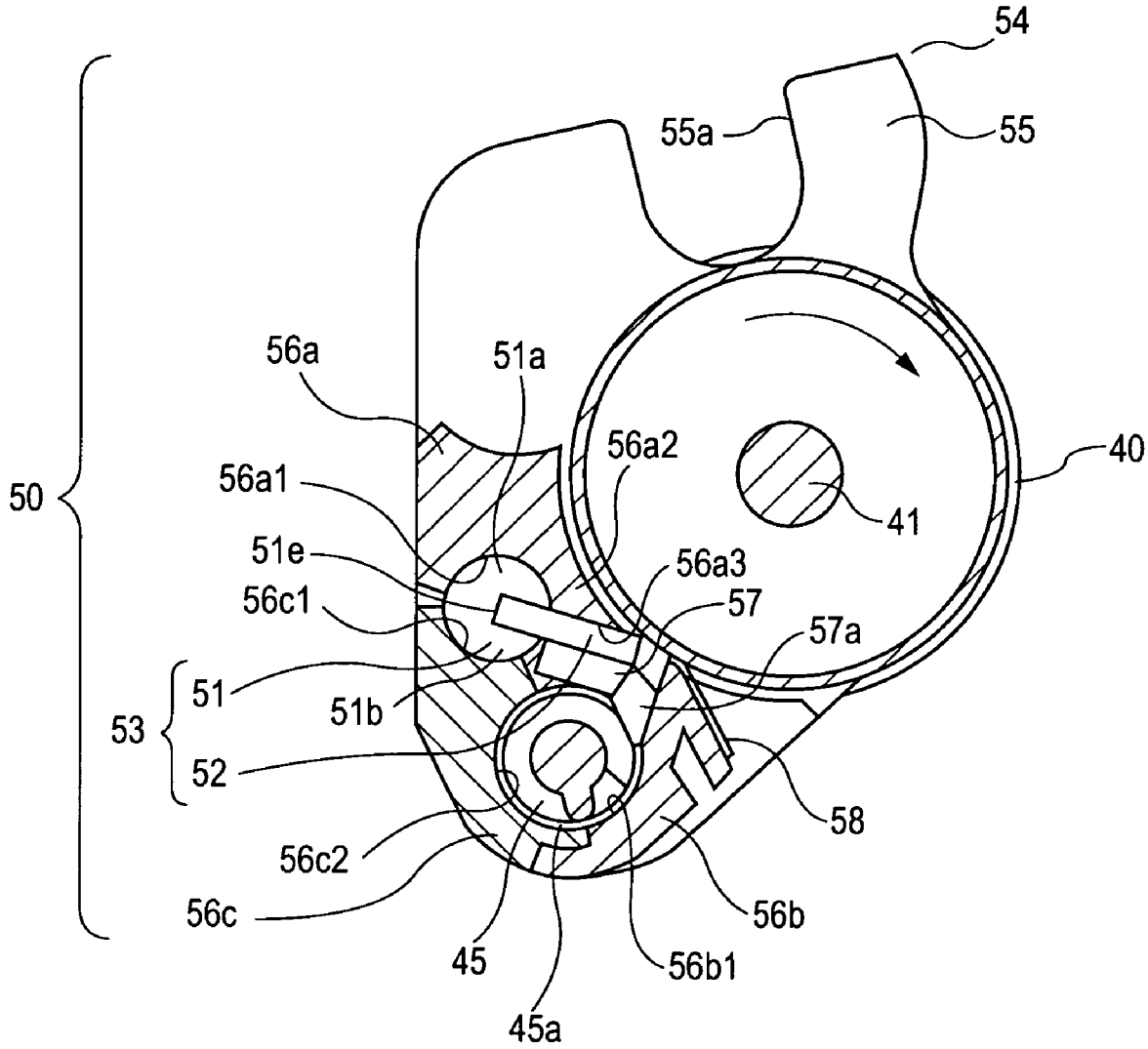
FIG. 10 is a sectional view illustrating the structure of the cleaning unit.

FIG. 10 is a sectional view illustrating an exemplary structure of the C unit 50. The C unit 50 has the photosensitive drum 40 and the cleaning member 53, which is oriented in a direction opposite the rotational direction of the photosensitive drum 40. An urging member 57 and the waste toner screw 45 are provided below the cleaning member 53 in the above order. A toner-receiving member 58 faces the end of the elastic blade 52. The drum shaft 41 of the photosensitive drum 40 and the waste toner screw 45 are rotatably supported by the side cover 55 of the C unit frame 54 with bearings (not shown).

Still referring to FIG. 10, the cleaning member 53 scrapes the untransferred toner off the circumferential surface of the photosensitive drum 40, which rotates in the arrow direction. The toner-receiving member 58 receives the toner scraped off by the cleaning member 53 and guides it to the waste toner screw 45. The waste toner screw 45 carries the toner scraped off by the cleaning member 53 to a waste toner bottle (not shown) in the longitudinal direction of the C unit 50. The urging member 57 prevents the leakage of the toner scraped off by the cleaning member 53 from the C unit frame 54.

The cleaning member 53 includes the elastic blade 52, which comes into contact with and cleans the surface of the photosensitive drum 40, and a cylindrical holder (hereinafter referred to as a "holder") 51 that holds the elastic blade 52. In this embodiment, the cylindrical holder 51 has a diameter of 6 mm, and a groove 51*e* having a width of 2 mm and a depth of 4 mm is formed on the circumferential surface of the holder 51. A drawn stainless cylinder is used as the holder 51 in view of productivity in this embodiment. Alternatively, the holder 51 used may be a polished cylindrical steel bar having a diameter of 6 mm, on which the groove 51*e* may be formed by, for example, horizontal milling.

The elastic blade 52 can be formed of urethane rubber; however, it is recognized that the blade 52 may be made from other materials with similar characteristics as well. In this embodiment, the elastic blade 52 is fitted into the groove 51*e*, as a supporting part of the holder 51, before the holder 51 and the elastic blade 52 are bonded by fusion, thus forming the cleaning member 53. The end of the cleaning member 53 is cut by laser such that the cleaning member 53 has a length of 8.0±0.05 mm from the axis of the holder 51. The elastic blade 52 can be detached from the holder 51 by applying a shear force to the elastic blade 52 in the thickness direction with the holder 51 being fixed. Thus, the elastic blade 52 can be individually removed for recycling.

Figure 11:
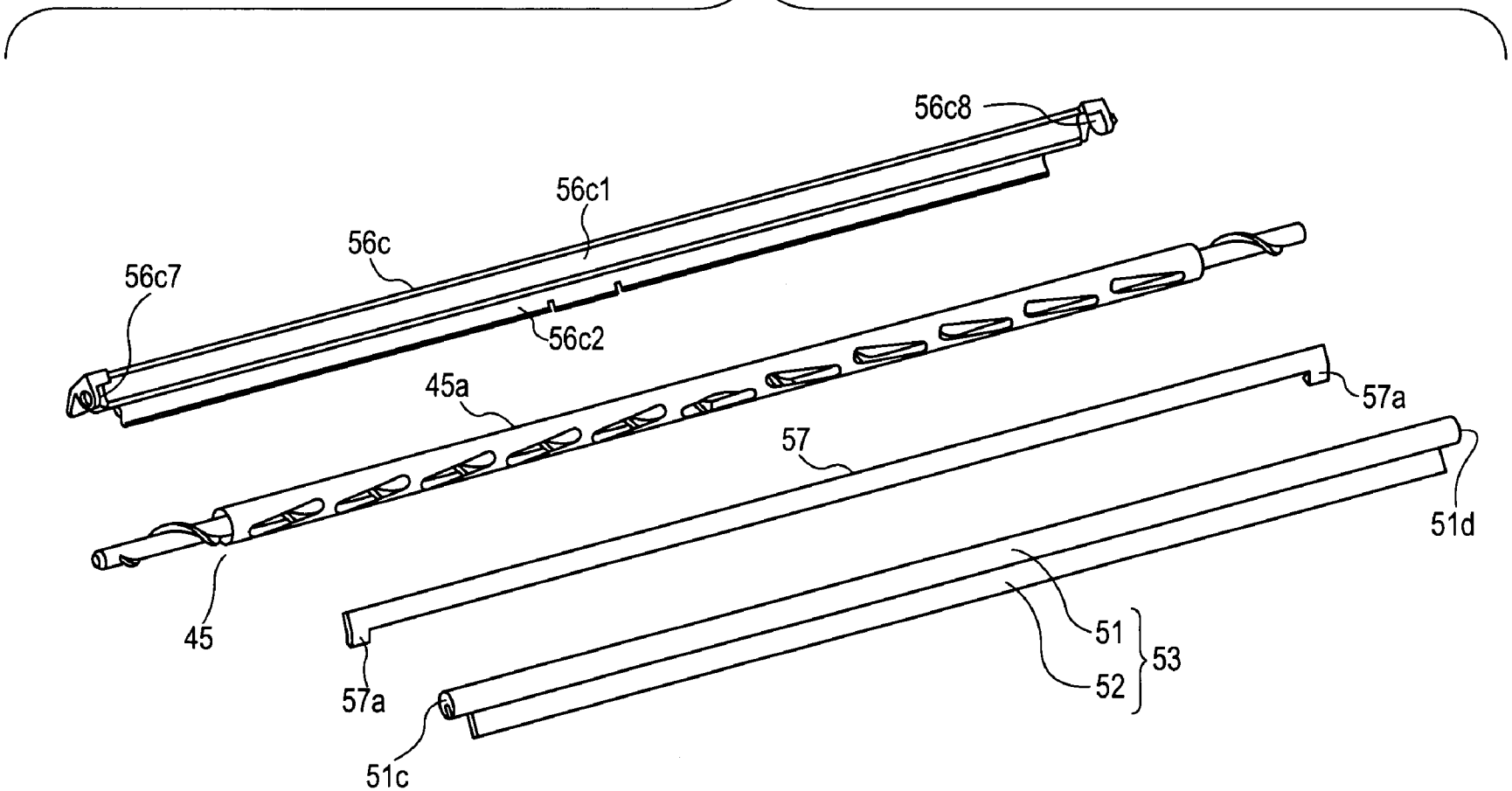
FIG. 11 is an exploded perspective view illustrating a second lower frame portion of a cleaning unit frame, a waste toner screw, an urging member, and a cleaning member according to the first embodiment.
Figure 12:
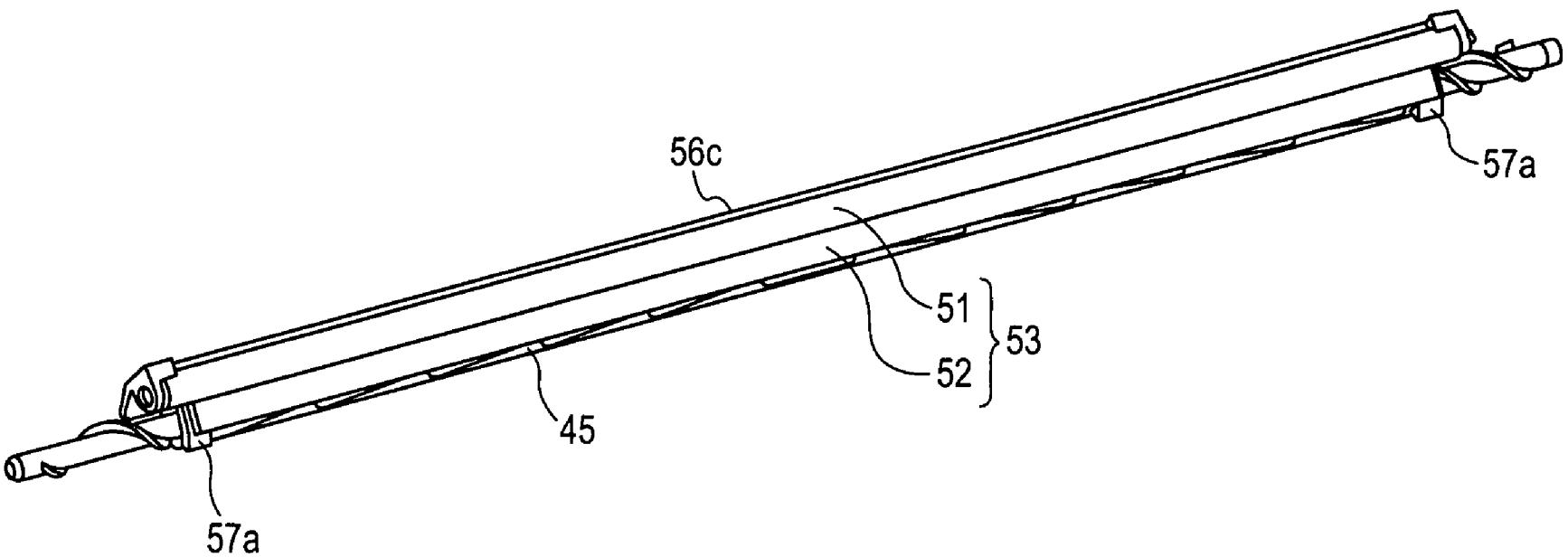
FIG. 12 is a perspective view illustrating how the second lower frame portion supports the waste toner screw, the urging member, and the cleaning member.

The structure supporting the cleaning member 53 in the C unit frame 54 is described below with reference to FIGS. 10 to 12. FIG. 11 is an exploded perspective view illustrating a second lower frame portion 56*c* of the C unit frame 54, the waste toner screw 45, the urging member 57, and the cleaning member 53. FIG. 12 is a perspective view illustrating how the second lower frame portion 56*c* supports the waste toner screw 45, the urging member 57, and the cleaning member 53.

The C unit frame 54 includes an upper frame portion 56*a* coupled to the side cover 55, a first lower frame portion 56*b* coupled to the side cover 55, and the second lower frame portion 56*c*, which is substantially attached to the side cover 55. A holder-receiving part 56*a*1, which is a cylindrical-shaped groove, is formed on the bottom surface of the upper frame portion 56*a*. The holder-receiving part 56*a*1 has the same length as the holder 51 of the cleaning member 53. The holder-receiving part 56*a*1 comes into contact with and supports a first engaging part 51*a* provided on substantially the top half of the circumferential surface of the holder 51. The first engaging part 51*a* extends substantially over the length of the holder 51 in the longitudinal direction of the cleaning member 53. The upper frame portion 56*a* also has a rotation-limiting part 56*a*2 provided closer to the photosensitive drum 40 than the holder-receiving part 56*a*1. The rotation-limiting part 56*a*2 has substantially the same length as the elastic blade 52. A flat surface 56*a*3 of the rotation-limiting part 56*a*2 comes into contact with and supports a surface of the elastic blade 52 over the area of the surface.

A screw-receiving part 56*b*1, which is a cylindrical-shaped groove, is provided on the surface of the first lower frame portion 56*b* opposite the waste toner screw 45. The screw-receiving part 56*b*1 has substantially the same length as a cylindrical casing 45*a* of the waste toner screw 45. The screw-receiving part 56*b*1 comes into contact with and supports the right of the circumferential surface of the cylindrical casing 45*a* over the length and the end surfaces thereof. The toner-receiving member 58 is bonded to the outer surface of the first lower frame portion 56*b* by an appropriate method.

A holder-receiving part 56*c*1, which is a cylindrical-shaped groove, is formed on the top surface of the second lower frame portion 56*c*. The holder-receiving part 56*c*1 has the same length as the holder 51 of the cleaning member 53. The holder-receiving part 56*c*1 comes into contact with and supports a second engaging part 51*b* of the cleaning member 53. The second engaging part 51*b* is provided on substantially the bottom half of the circumferential surface of the holder 51, and extends substantially over the length of the holder 51 in the longitudinal direction of the cleaning member 53.

The holder 51 has end surfaces 51*c* and 51*d* at the ends in the longitudinal direction. Limiting parts 56*c*7 and 56*c*8 provided at the ends of the second lower frame portion 56*c* in the longitudinal direction come into contact with the end surfaces 51*c* and 51*d* to limit the position of the cleaning member 53 in the longitudinal direction.

A screw-receiving part 56*c*2, which is a cylindrical-shaped groove, is provided on the surface of the second lower frame portion 56*c* opposite the waste toner screw 45. The screw-receiving part 56*c*2 has substantially the same length as the cylindrical casing 45*a* of the waste toner screw 45. The screw-receiving part 56*c*2 comes into contact with and supports the left of the circumferential surface of the cylindrical casing 45*a* over the length and the end surfaces thereof. The ends of the second lower frame portion 56*c* are substantially attached to the side cover 55*a* with, for example, screws.

The urging member 57 is provided between the waste toner screw 45 and the elastic blade 52 of the cleaning member 53 to bring the elastic blade 52 into contact with the rotation-limiting part 56*a*2 of the upper frame portion 56*a*. The urging member 57 is slightly longer than the elastic blade 52. Leakage-preventing portions 57*a* are provided at the ends of the urging member 57 (see FIGS. 11-12). The leakage-preventing portions 57*a* extend along the circumferential surface of the cylindrical casing 45*a* of the waste toner screw 45. The urging member 57 is disposed between the waste toner screw 45 and the other surface of the elastic blade 52 to fix the elastic blade 52 by means of an elastic and/or resilient force. The urging member 57 is formed of an elastomer such as urethane rubber.

In the C unit frame 54, as described above, the holder 51 of the cleaning member 53 is supported by the holder-receiving part 56*a*1 of the upper frame portion 56*a* and the holder-receiving part 56*c*1 of the second lower frame portion 56*c*. In addition, the second lower frame portion 56*c* limits the longitudinal movement of the cleaning member 53. The longitudinal movement refers to the movement in the Z direction described above (the axial direction of the photosensitive drum 40).

The upper frame portion 56*a*, which has the holder-receiving part 56*a*1, and the second lower frame portion 56*c*, which has the holder-receiving part 56*c*1, fix the position of the cleaning member 53 with respect to the photosensitive drum 40. In addition, the rotation-limiting part 56*a*2 of the upper frame portion 56*a* comes into contact with one surface of the elastic blade 52 to limit the movement of the cleaning member 53 in the rotational direction of the photosensitive drum 40.

On the other hand, the urging member 57 comes into contact with the other surface of the elastic blade 52 to support the cleaning member 53. The leakage-preventing portions 57*a* of the urging member 57 come in close contact with the ends of the cleaning member 53 and the ends of the cylindrical casing

45*a* of the waste toner screw 45 to prevent the leakage of toner therefrom. In addition, the rotation-limiting part 56*a*2 of the upper frame portion 56*a* comes into contact with the elastic blade 52 to prevent the curling thereof.

Figure 13A:
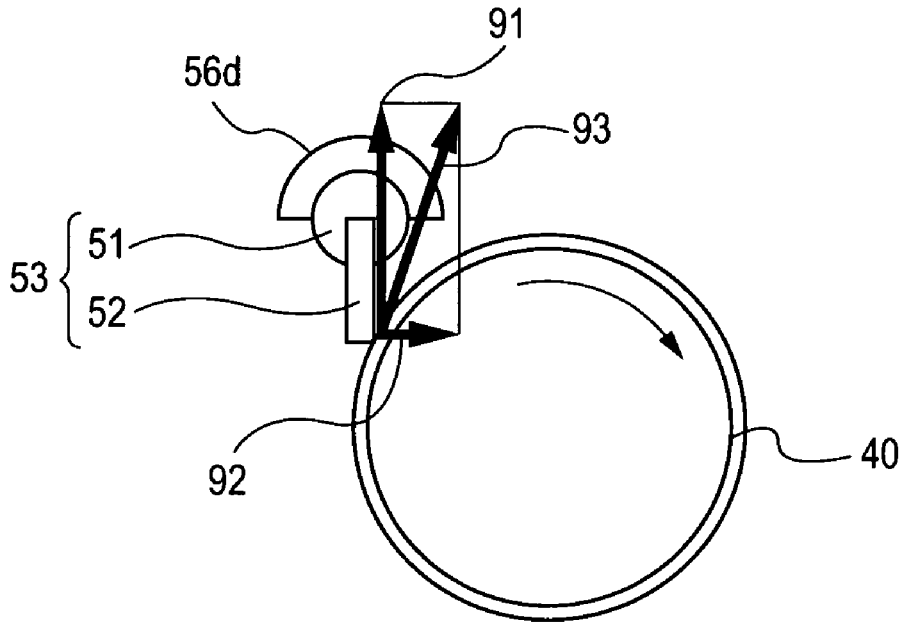
FIGS. 13A and 13B are schematic diagrams illustrating the structure supporting the cleaning member.
Figure 13B:
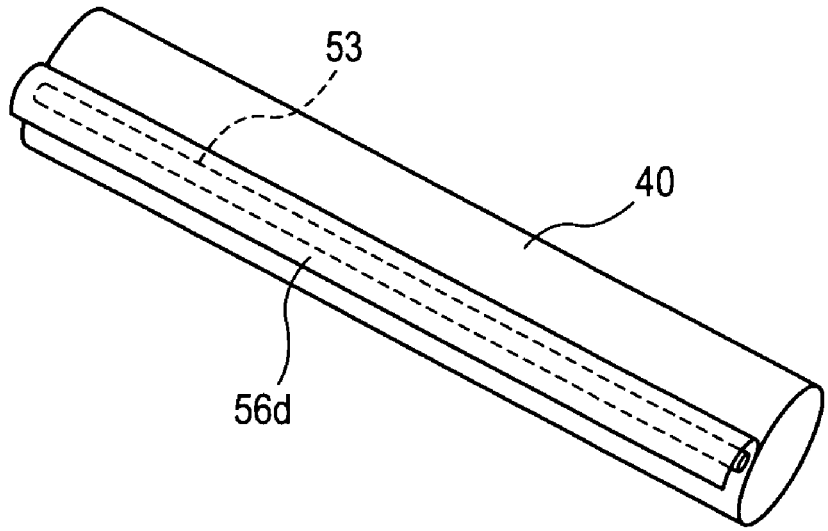

FIGS. 13A and 13B are a sectional view and a perspective view from above, respectively, illustrating the structure supporting the cleaning member 53 in the C unit 50 in this embodiment. In the drawings, the upper frame portion 56*a* and the second lower frame portion 56*c* are collectively illustrated as a frame portion 56*d*. When the photosensitive drum 40 rotates in the arrow direction, a friction force 93 occurs in the tangential direction of the photosensitive drum 40 and the elastic blade 52. This friction force 93 is resolved into forces 91 and 92. The force 91 acts on the cleaning member 53, which is supported by the frame portion 56*d*.

The diameter of the holder 51 can be reduced while maintaining the rigidity and highly precise external dimensions of the holder 51 because the holder 51 has a cylindrical shape. When the force 91 is applied to the elastic blade 52, the frame portion 56*d* supports the circumferential surface of the holder 51 substantially over the length so that the holder 51 is in a continuous-beam state and thus causes less deflection.

In the above structure, in which the holder 51 causes less deflection, the cleaning member 53 can be positioned with high precision with respect to the photosensitive drum 40. The contact pressure due to a drum shaft torque is conventionally high for avoidance of insufficient cleaning, about 19.6±5.9 N·cm (2.0±0.6 kgf·cm); the pressure can be reduced to 11.8±2.9 N·cm (1.2±0.3 kgf·cm) by positioning the end of the elastic blade 52 with higher precision.

The elastic blade 52 of the cleaning member 53 is fitted and supported in the groove 51*e*, which is a supporting part provided on the holder 51. The groove 51*e* is provided inside the engaging parts 51*a* and 51*b* in the thickness direction of the elastic blade 52; that is, the groove 51*e* is provided inside the circumferential surface of the holder 51 to reduce the size of the cleaning member 53. In addition, the engaging parts 51*a* and 51*b* are supported by the holder-receiving part 56*a*1 of the upper frame portion 56*a* and the holder-receiving part 56*c*1 of the second lower frame portion 56*c*, respectively. This structure can precisely support the cleaning member 53 and position the elastic blade 52 with respect to the photosensitive drum 40 to improve the cleaning performance of the cleaning member 53.

Furthermore, the cleaning member 53 is supported by the holder-receiving part 56*a*1 of the upper frame portion 56*a* and the holder-receiving part 56*c*1 of the second lower frame portion 56*c* without additional components such as screws. This structure can therefore reduce the size of the C unit frame 54 and that of the C unit 50.

Figure 18:
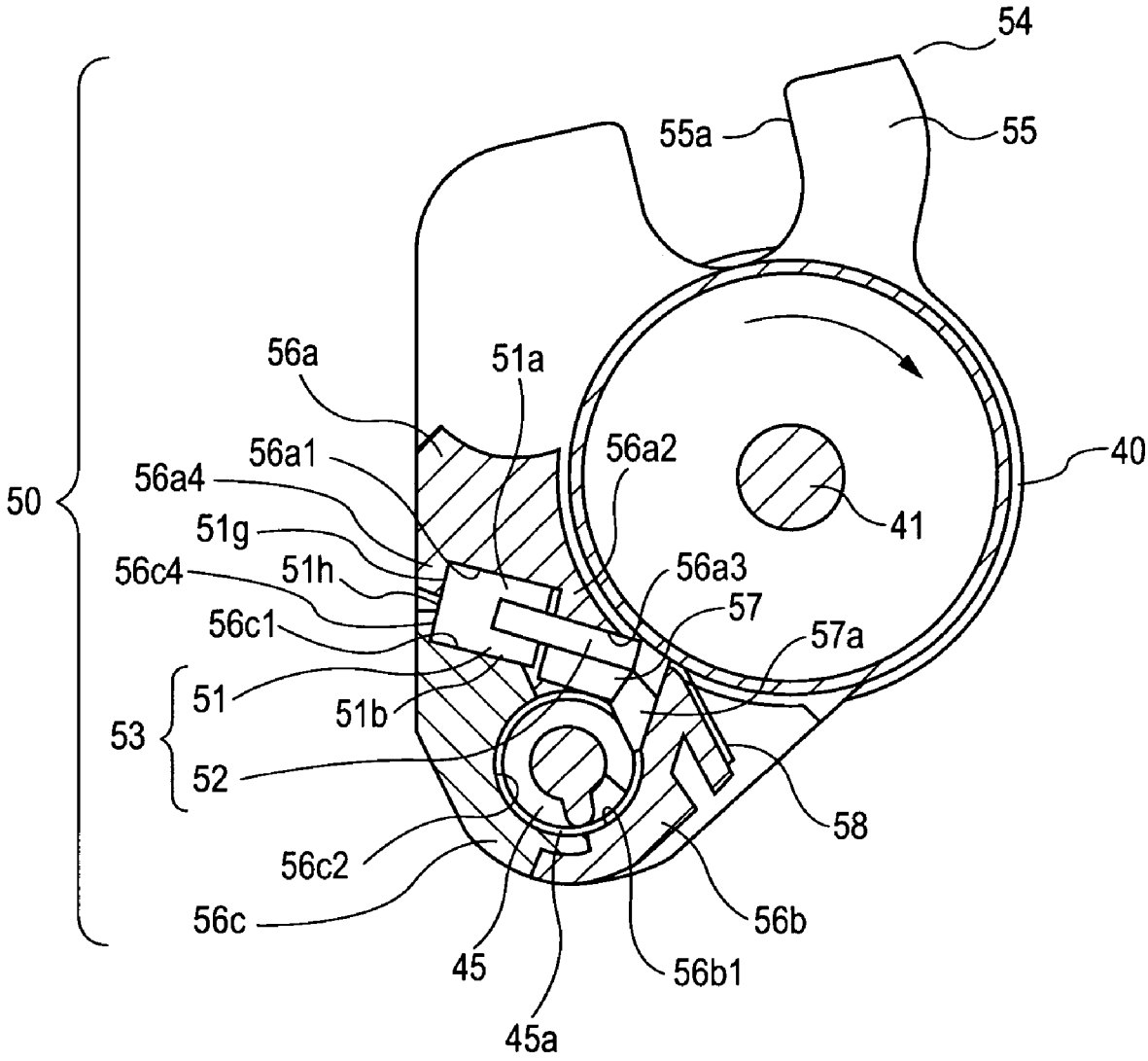
FIG. 18 is a sectional view illustrating the structure supporting another cleaning unit according to the first embodiment.

In an alternative embodiment, the holder 51 may also have a rectangular cross-sectional shape, as shown in FIG. 18. The holder-receiving part 56*a*1 of the upper frame portion 56*a* and the holder-receiving part 56*c*1 and the second lower frame portion 56*c* support the engaging parts 51*a* and 51*b*, respectively, in the thickness direction of the elastic blade 52. On the other hand, a holder-receiving part 56*a*4 of the upper frame portion 56*a* and a holder-receiving part 56*c*4 of the second lower frame portion 56*c* press and support engaging parts 51*g* and 51*h* of the holder 51, respectively, to position the holder 51 in a direction perpendicular to the thickness direction. The pressure applied to the holder-receiving parts 56*a*4 and 56*c*4 is the pressure applied to the elastic blade 52 by the photosensitive drum 40.

Second Exemplary Embodiment

Figure 15:
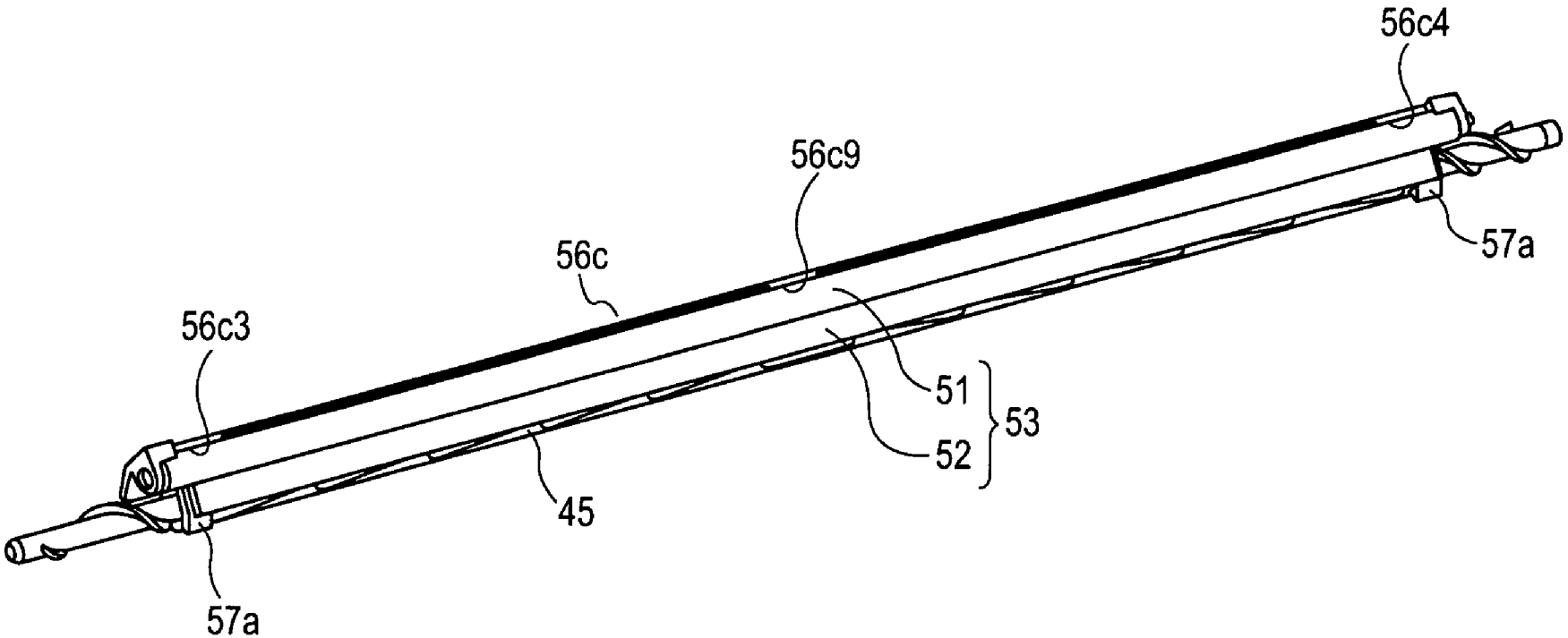
FIG. 15 is a perspective view illustrating how the second lower frame portion according to the second embodiment supports the waste toner screw, the urging member, and the cleaning member.
Figure 16:
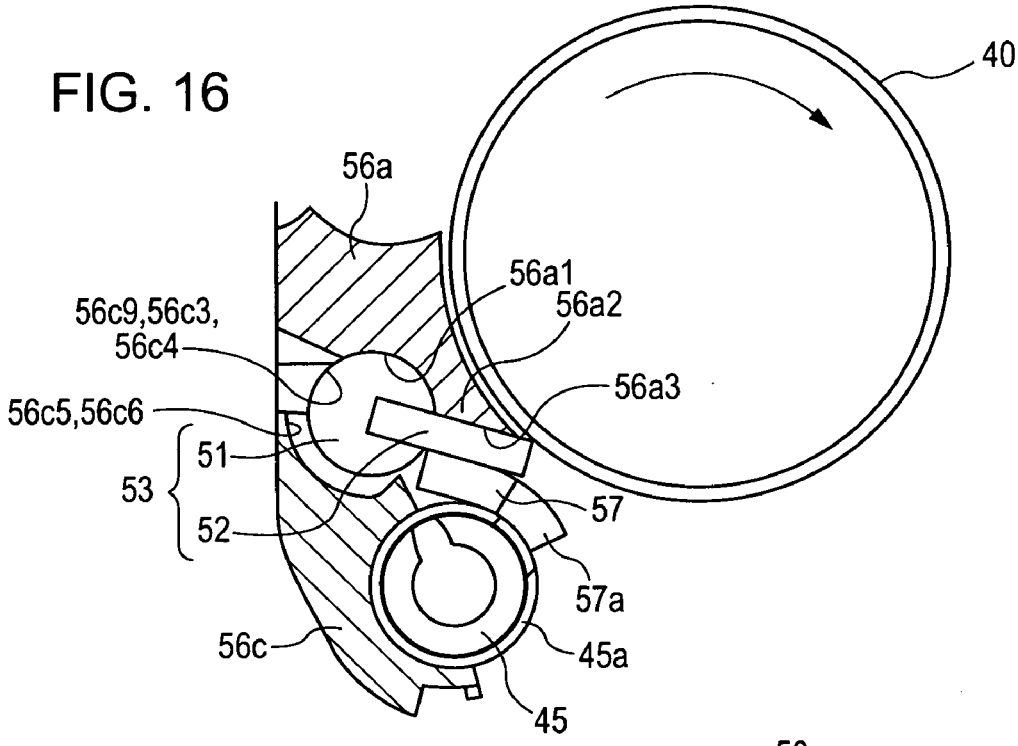
FIG. 16 is a sectional view illustrating the main part of the structure supporting a cleaning member according to a second embodiment.

Another exemplary structure for supporting the holder 51 is described below with regard to FIGS. 14 through 16. In this embodiment, the holder 51 is supported at three positions: the end parts of the holder 51 and a position therebetween in the longitudinal direction. This structure provides similar advantages as in the first embodiment. The end parts of the holder 51 herein refer to parts including the ends of the holder 51 and the vicinities thereof in the longitudinal direction.

Figure 14:
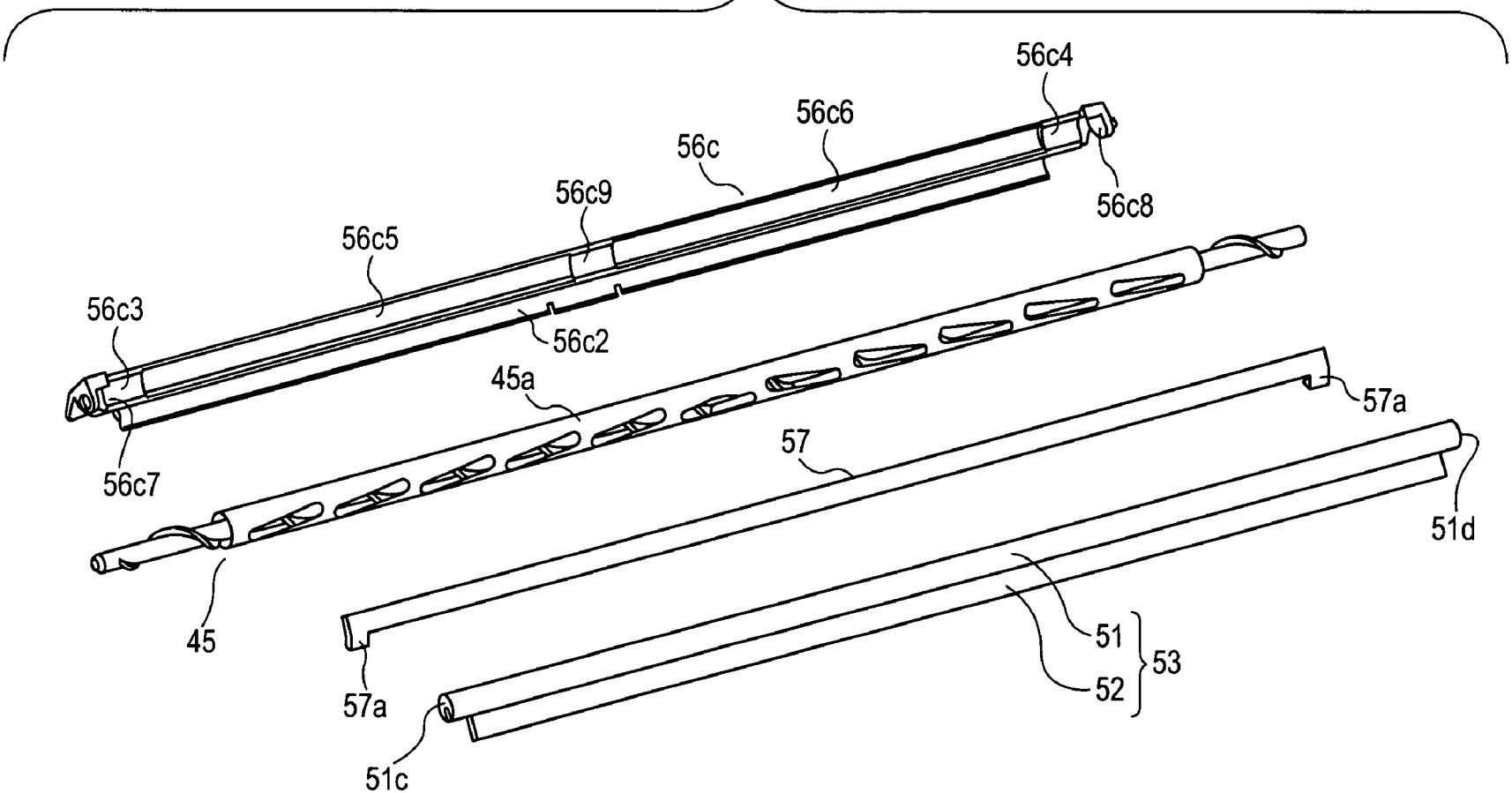
FIG. 14 is an exploded perspective view illustrating a second lower frame portion of a cleaning unit, a waste toner screw, an urging member, and a cleaning member according to a second embodiment.

FIG. 14 is an exploded perspective view illustrating a second lower frame portion 56*c* of the C unit frame 54 (see FIG. 7), the waste toner screw 45, the urging member 57, and the cleaning member 53 in this embodiment. FIG. 15 is a perspective view illustrating how the second lower frame portion 56*c* supports the waste toner screw 45, the urging member 57, and the cleaning member 53. FIG. 16 is a sectional view illustrating the main part of the structure supporting the cleaning member 53 in the C unit 50.

The second lower frame portion 56*c* has cylindrically-shaped holder-receiving parts 56*c*3 and 56*c*4 at the positions corresponding to the end parts of the holder 51 and a cylindrical-shaped holder-receiving part 56*c*9 at the position corresponding to the center of the holder 51. Surfaces 56*c*5 and 56*c*6 between the holder-receiving part 56*c*9 and the holder-receiving parts 56*c*3 and 56*c*4 are provided in the form of grooves deeper than the holder-receiving parts 56*c*9, 56*c*3, and 56*c*4.

Accordingly, the holder-receiving parts 56*c*3 and 56*c*4 come into contact with and support the end parts of the bottom half of the circumferential surface and the end surfaces of the holder 51, and the holder-receiving part 56*c*9 comes into contact with and supports the center of the bottom half of the circumferential surface of the holder 51.

The holder-receiving part 56*c*9 is provided at the position corresponding to about the center of the holder 51 in this embodiment, though any number of holder-receiving parts may be provided at any positions between the holder-receiving parts 56*c*3 and 56*c*4.

Third Exemplary Embodiment

Figure 17:
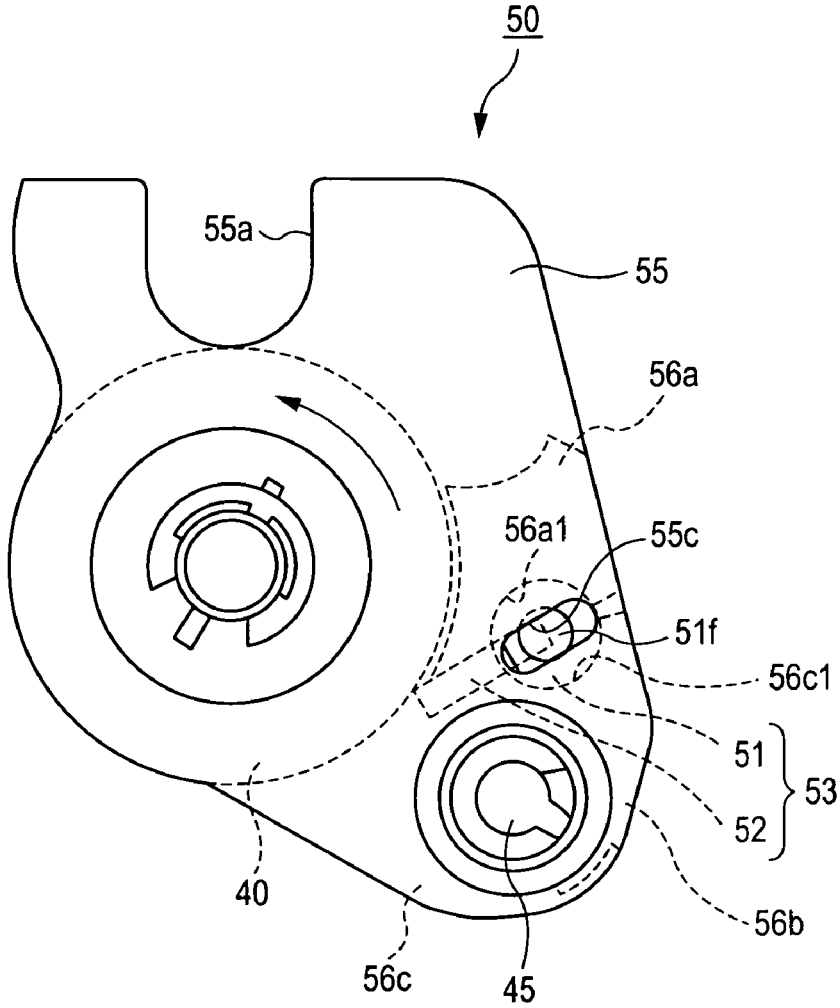
FIG. 17 is a side view illustrating the structure of a cleaning unit according to a third embodiment.

An exemplary structure of the C unit 50 in a third embodiment is described below with reference to FIG. 17, which is a side view illustrating the structure of the C unit 50 in this embodiment.

In the first embodiment, as described above, the movement of the cleaning member 53 in the rotational direction of the photosensitive drum 40 is limited by the upper frame portion 56*a* of the C unit frame 54 and the urging member 57.

In the third embodiment, the movement of the cleaning member 53 in the rotational direction of the photosensitive drum 40 is limited by the upper frame portion 56*a* and the side cover 55 of the C unit frame 54. The third embodiment therefore does not require the urging member 57 used in the first embodiment.

In this embodiment, additionally, the holder 51 of the cleaning member 53 has a D-shaped part 51*f* at each shaft end. The D-shaped part 51*f* is fitted into an elongated hole 55*c* provided in the side cover 55 to limit the rotation of the cleaning member 53. In addition, the movement of the cleaning member 53 in the longitudinal direction is limited by the holder-receiving parts 56*c*7 and 56*c*8 of the second lower frame portion 56*c* of the C unit frame 54, as in the first embodiment. This structure eliminates the need for additional components for fixing the cleaning member 53, such as screws and the urging member 57, to reduce the size of the C unit frame 54 by eliminating the space required for such component. This results in a reduction in the size of the C unit 50.

The C units 50 in the embodiment described above, can reduce the deflection of the holder 51 with a simple structure including the holder 51 and the C unit frame 54. The C units 50 can also simultaneously achieve a reduction in the size of the holder 51 and highly precise positioning of the cleaning member 53 with respect to the photosensitive drum 40.

In addition, the C units 50 can reduce the contact pressure on the circumferential surface of the cleaning member 53 by preventing the curling of the elastic blade 52. The C unit frame 54 has the rotation-limiting part **56*a*2, which limits the movement of the cleaning member 53 in the rotational direction of the photosensitive drum 40. Furthermore, the C units 50 have the urging member 57, which brings the elastic blade 52 into contact with the rotation-limiting part 56*a*2**, to prevent toner leakage.

Other Aspects of the Present Invention

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-362930 filed Dec. 15, 2004 and No. 2005-304319 filed Oct. 19, 2005, which are hereby incorporated by reference herein in their entirety.

What is claimed is:

1. A cleaning unit configured for use in an electrophotographic image-forming apparatus that forms an image on a recording medium, the cleaning unit comprising:

a frame; and a cleaning member for removing developer from an electrophotographic photosensitive member, the cleaning member including, a longitudinally-shaped planar elastic blade that comes into contact with the electrophotographic photosensitive member to remove the developer from a surface thereof; and a holder configured to support the elastic blade, the holder including an engaging part that engages with the frame to secure the cleaning member to the frame; and a supporting part configured to hold the elastic blade inside the engaging part to support the elastic blade, wherein the frame further includes a first frame portion having a first receiving part that engages with the engaging part; and a second frame portion having a second receiving part that engages with the engaging part opposite the first frame portion.

2. The cleaning unit according to claim 1, wherein the holder has a cylindrical cross-sectional shape;

the engaging part is provided on a circumferential surface of he holder; and the supporting part is a groove disposed through the circumferential surface of the holder in a longitudinal direction of the cleaning member.

3. The cleaning unit according to claim 2, the frame having a limiting part adapted to come into contact with the elastic blade so as to limit the rotation of the cleaning member about the engaging part when the electrophotographic photosensitive member rotates.

4. The cleaning unit according to claim 3, further comprising an urging member for urging the elastic blade against the frame.

5. The cleaning unit according to claim 1, wherein the engaging part engages with the frame substantially over the length of the cleaning member.

6. The cleaning unit according to claim 1, wherein the engaging part engages with the frame at ends of the engaging part and a position therebetween in the longitudinal direction of the cleaning member.

7. The cleaning unit according to claim 1, the second frame portion including a screw adapted to carry developer removed from the surface of the electrophotographic photosensitive member by the elastic blade.

8. The cleaning unit according to claim 1, the holder having end surfaces configured to come into contact with the frame to limit the position of the cleaning member in the longitudinal direction thereof.

9. A process cartridge configured to be detachably attached to a main body of an electrophotographic image-forming apparatus that forms an image on a recording medium, the process cartridge comprising:

a frame;

an electrophotographic photosensitive member; and a cleaning member configured to remove developer from the electrophotographic photosensitive member, the cleaning member including, a longitudinally-shaped planar elastic blade positioned to come into contact with the electrophotographic photosensitive member to remove the developer from a surface thereof; and a holder configured to support the elastic blade, the holder including an engaging part that engages with the frame to secure the cleaning member to the frame; and a supporting part that holds the elastic blade inside the engaging part to support the elastic blade, wherein the frame further includes a first frame portion having a first receiving part that engages with the engaging part; and a second frame portion having a second receiving part that engages with the engaging part opposite the first frame portion.

10. The process cartridge according to claim 9, wherein the holder has a cylindrical cross-sectional shape;

the engaging part is provided on a circumferential surface of the holder; and the supporting part is a groove disposed through the circumferential surface of the holder in the longitudinal direction of the cleaning member.

11. The process cartridge according to claim 10, the frame including a limiting part that comes into contact with the elastic blade so as to limit the rotation of the cleaning member about the engaging part when the electrophotographic photosensitive member rotates.

12. The process cartridge according to claim 11, further comprising an urging member for urging the elastic blade against the frame.

13. The process cartridge according to claim 9, wherein the engaging part engages with the frame substantially over the length of the engaging part in the longitudinal direction of the cleaning member.

14. The process cartridge according to claim 9, wherein the engaging part engages with the frame at ends of the engaging part and a position therebetween in the longitudinal direction of the cleaning member.

15. The process cartridge according to claim 9, the second frame portion having a screw that carries the developer removed from the surface of the electrophotographic photosensitive member by the elastic blade.

16. The process cartridge according to claim 9, the holder having end surfaces that come into contact with the frame to limit the position of the cleaning member in the longitudinal direction thereof.

17. A cleaning member used in an electrophotographic image-forming apparatus that forms an image on a recording medium, the cleaning member configured to remove developer from an electrophotographic photosensitive member, the cleaning member comprising:

a longitudinally-shaped planar elastic blade configured to interface a surface of the electrophotographic photosensitive member to remove the developer from the surface thereof; and a holder configured to support the elastic blade, the holder including an engaging part that engages with a frame of a cleaning unit to secure the cleaning member to the frame, a supporting part that holds the elastic blade inside the engaging part to support the elastic blade, and end surfaces that come into contact with the frame to limit the position of the cleaning member in the longitudinal direction thereof.

18. The cleaning member according to claim 17, wherein the holder has a cylindrical shape;

the engaging part is provided on a circumferential surface of the holder; and the supporting part is a groove disposed through the circumferential surface of the holder in a longitudinal direction of the cleaning member.

19. The cleaning member according to claim 17, wherein the engaging part is configured to engage with the frame substantially over the length of the cleaning member.

20. The cleaning member according to claim 17, wherein the engaging part is configured to engage with the frame at the ends of the engaging part and a position therebetween in the longitudinal direction of the cleaning member.

21. An electrophotographic image-forming apparatus that forms an image on a recording medium, comprising:

(i) an electrophotographic photosensitive member;

(ii) a developing unit for developing an electrophotographic latent image formed on a surface of the electrophotographic photosensitive member;

(iii) a conveying unit for conveying the recording medium; and (iv) a cleaning unit including:

a frame; and a cleaning member configured to remove developer from the electrophotographic photosensitive member, the cleaning member including:

a longitudinally-shaped planar elastic blade that comes into contact with the electrophotographic photosensitive member to remove the developer from the surface thereof; and a holder configured to support the elastic blade, the holder including an engaging part that engages with the frame to secure the cleaning member to the frame; and a supporting part that holds the elastic blade inside the engaging part to support the elastic blades, wherein the frame further includes a first frame portion having a first receiving part that engages with the engaging part, and a second frame portion having a second receiving part that engages with the engaging part opposite the first frame portion.

22. An electrophotographic image-forming apparatus that forms an image on a recording medium comprising:

(i) a detachable process cartridge including, a frame;

an electrophotographic photosensitive member; and a cleaning member for removing developer from the electrophotographic photosensitive member, the cleaning member including:

a longitudinally-shaped planar elastic blade configured to come into contact with the electrophotographic photosensitive member to remove the developer from a surface thereof; and a holder configured to support the elastic blade, the holder including an engaging part that engages with the frame to secure the cleaning member to the frame; and a supporting part that holds the elastic blade inside the engaging part to support the elastic blade in the thickness direction thereof, wherein the frame further includes a first frame portion having a first receiving part that engages with the engaging part, and a second frame portion having a second receiving part that engages with the engaging part opposite the first frame portion;

(ii) an attaching member for detachable attachment of the process cartridge; and (iii) a conveying unit for conveying the recording medium.

* * * * *